US009611119B2

(12) United States Patent
Tahara

(10) Patent No.: US 9,611,119 B2
(45) Date of Patent: Apr. 4, 2017

(54) SHEET DISCHARGING DEVICE AND IMAGE FORMING APPARATUS THEREWITH

(71) Applicant: KYOCERA Document Solutions Inc., Osaka (JP)

(72) Inventor: Mitsuhiro Tahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/835,668

(22) Filed: Aug. 25, 2015

(65) Prior Publication Data

US 2016/0060065 A1 Mar. 3, 2016

(30) Foreign Application Priority Data

Sep. 2, 2014 (JP) ..... 2014-177957

(51) Int. Cl.
*B65H 31/26* (2006.01)
*B65H 29/70* (2006.01)
(Continued)

(52) U.S. Cl.
CPC ..... *B65H 29/70* (2013.01); *B65H 29/14* (2013.01); *B65H 29/20* (2013.01); *B65H 29/22* (2013.01);
(Continued)

(58) Field of Classification Search
CPC ..... B65H 29/00; B65H 29/14; B65H 29/20; B65H 29/22; B65H 29/52; B65H 29/58;
(Continued)

(56) References Cited

U.S. PATENT DOCUMENTS 7,703,764 B2 * 4/2010 Kusama ..... B65H 29/58 271/186
8,348,262 B2 * 1/2013 Shingai ..... B65H 31/02 271/212
(Continued)

FOREIGN PATENT DOCUMENTS

JP 05-294530 11/1993
JP 2013-147324 A 8/2013

OTHER PUBLICATIONS

Japanese Office Action dated Jun. 7, 2016, issued by the Japanese Patent Office in corresponding application JP 2014-177957.

*Primary Examiner* — Prasad Gokhale
(74) *Attorney, Agent, or Firm* — Stein IP, LLC

(57) ABSTRACT

A sheet discharging device has a discharge port, a discharge tray, a discharge roller including first and second rollers, a flick-out pulley, a sheet pressing member, and a pressing rib. The flick-out pulley is formed coaxially with the rotary shaft of the first roller at an interval from an end of the first roller, and has a circumferential edge and a plurality of projections protruding from it. The sheet pressing member is supported on a pivot axis provided on the downstream side of the discharge roller with respect to the sheet discharge direction to be swingable in the sheet discharge direction. A pressing rib is arranged at a position overlapping the flick-out pulley in the direction along the pivot axis as seen from the sheet discharge direction.

7 Claims, 6 Drawing Sheets

(51) Int. Cl.

| | |
|---|---|
| ***B65H 29/14*** | (2006.01) |
| ***G03G 15/00*** | (2006.01) |
| ***B65H 29/20*** | (2006.01) |
| ***B65H 29/22*** | (2006.01) |
| ***B65H 29/52*** | (2006.01) |
| ***B65H 31/02*** | (2006.01) |
| ***B65H 43/06*** | (2006.01) |

(52) U.S. Cl.
CPC ..... *B65H 29/52* (2013.01); *B65H 31/02* (2013.01); *B65H 43/06* (2013.01); *G03G 15/6552* (2013.01); *G03G 15/6573* (2013.01); *B65H 2301/4212* (2013.01); *B65H 2301/4421* (2013.01); *B65H 2404/1115* (2013.01); *B65H 2404/5214* (2013.01); *B65H 2404/63* (2013.01); *B65H 2701/1313* (2013.01); *B65H 2801/06* (2013.01); *G03G 2215/00911* (2013.01)

(58) Field of Classification Search
CPC B65H 29/70; B65H 43/06; B65H 2301/4421; B65H 2404/1115; B65H 2404/50; B65H 2404/522; B65H 2404/5214; B65H 2404/5221; B65H 2404/54; B65H 2404/61; B65H 2404/63; B65H 2701/1313; G03G 2215/00911
USPC ..... 271/207, 209, 220, 314, 315
See application file for complete search history.

(56) References Cited

U.S. PATENT DOCUMENTS

| | | | | |
|---|---|---|---|---|
| 9,073,722 | B2 * | 7/2015 | Uehara | B65H 29/22 |
| 2006/0181020 | A1 * | 8/2006 | Numao | B65H 27/00 271/314 |
| 2009/0189344 | A1 * | 7/2009 | Suzuki | B65H 29/52 271/314 |
| 2009/0295061 | A1 * | 12/2009 | Honda | B41J 13/0036 271/3.14 |
| 2009/0322010 | A1 * | 12/2009 | Kusama | B65H 29/58 271/3.14 |
| 2010/0232856 | A1 * | 9/2010 | Tanaka | B65H 29/14 399/405 |
| 2014/0239578 | A1 * | 8/2014 | Honda | B65H 31/02 271/217 |
| 2015/0008642 | A1 * | 1/2015 | Uehara | B65H 29/22 271/314 |
| 2016/0060071 | A1 * | 3/2016 | Tahara | B65H 29/70 271/176 |

* cited by examiner

SHEET DISCHARGING DEVICE AND IMAGE FORMING APPARATUS THEREWITH

INCORPORATION BY REFERENCE

This application is based upon and claims the benefit of priority from the corresponding Japanese Patent Application No. 2014-177957 filed on Sep. 2, 2014, the entire contents of which are incorporated herein by reference.

BACKGROUND

The present disclosure relates to a sheet discharging device used in a copier, a printer, a facsimile machine, a multifunction peripheral serving as all of them, or the like, and also relates to an image forming apparatus provided with such a sheet discharging device.

An image forming apparatus is provided with a sheet discharge roller for discharging sheets (of a recording medium such as paper) having images formed on them by an image forming section. A sheet that has been transported from the upstream side of a discharge roller is delivered by the discharge roller onto a discharge tray. Inconveniently, when the sheet is delivered from the discharge roller onto the discharge tray, the trailing edge of the sheet tends to remain suspended on a lower roller constituting the discharge roller.

To overcome the inconvenience, according to one configuration, a projection is formed on the lower roller constituting the discharge roller so that the projection thrusts forth the trailing edge of a sheet toward the discharge tray. However, the projection protrudes, in the radial direction, from the circumferential face of the lower roller forming a nip portion. As a result, inconveniently, when the sheet passes through the nip portion of the discharge roller, the projection may damage the sheet, or may leave its mark on the image formed on the sheet.

Thus, there have been proposed methods for reliably thrusting forth a sheet from the discharge roller without damaging the sheet or the image on it. For example, in a known sheet discharging device provided with a discharge roller which discharges a sheet at a pressed-contact portion where a first and a second roller are in pressed contact with each other, there is provided a flick-out pulley arranged coaxially with the rotary shaft of the first roller at an interval from it so that the flick-out pulley, with a projection protruding in the radial direction from its circumferential face, flicks out the trailing edge of a sheet that is discharged as the first roller rotates, wherein the distance from the center of rotation of the flick-out pulley to the tip end of the projection in the roller radial direction is equal to or smaller than the radius of the cylindrical portion of the first roller.

SUMMARY

According to one aspect of the present disclosure, a sheet discharging device includes a discharge port through which a sheet is discharged, a discharge tray which receives the sheet discharged through the discharge port, a discharge roller including a first roller and a second roller, a flick-out pulley, a sheet pressing member, and a pressing rib. The first and second rollers nip the sheet at a nip portion between them so as to discharge the sheet through the discharge port onto the discharge tray. The flick-out pulley is formed coaxially with the rotary shaft of the first roller at an interval from an end of the first roller, and has a circumferential edge and a plurality of projections protruding from it. The sheet pressing member is supported on a pivot axis provided on the downstream side of the discharge roller with respect to the sheet discharge direction so as to be swingable in the sheet discharge direction. A pressing rib protrudes from the opposite face of the sheet pressing member opposite the discharge roller, and is arranged at a position overlapping the flick-out pulley in the direction along the pivot axis as seen from the sheet discharge direction.

Further features and advantages of the present disclosure will become apparent from the description of embodiments given below.

DETAILED DESCRIPTION

Figure 1:
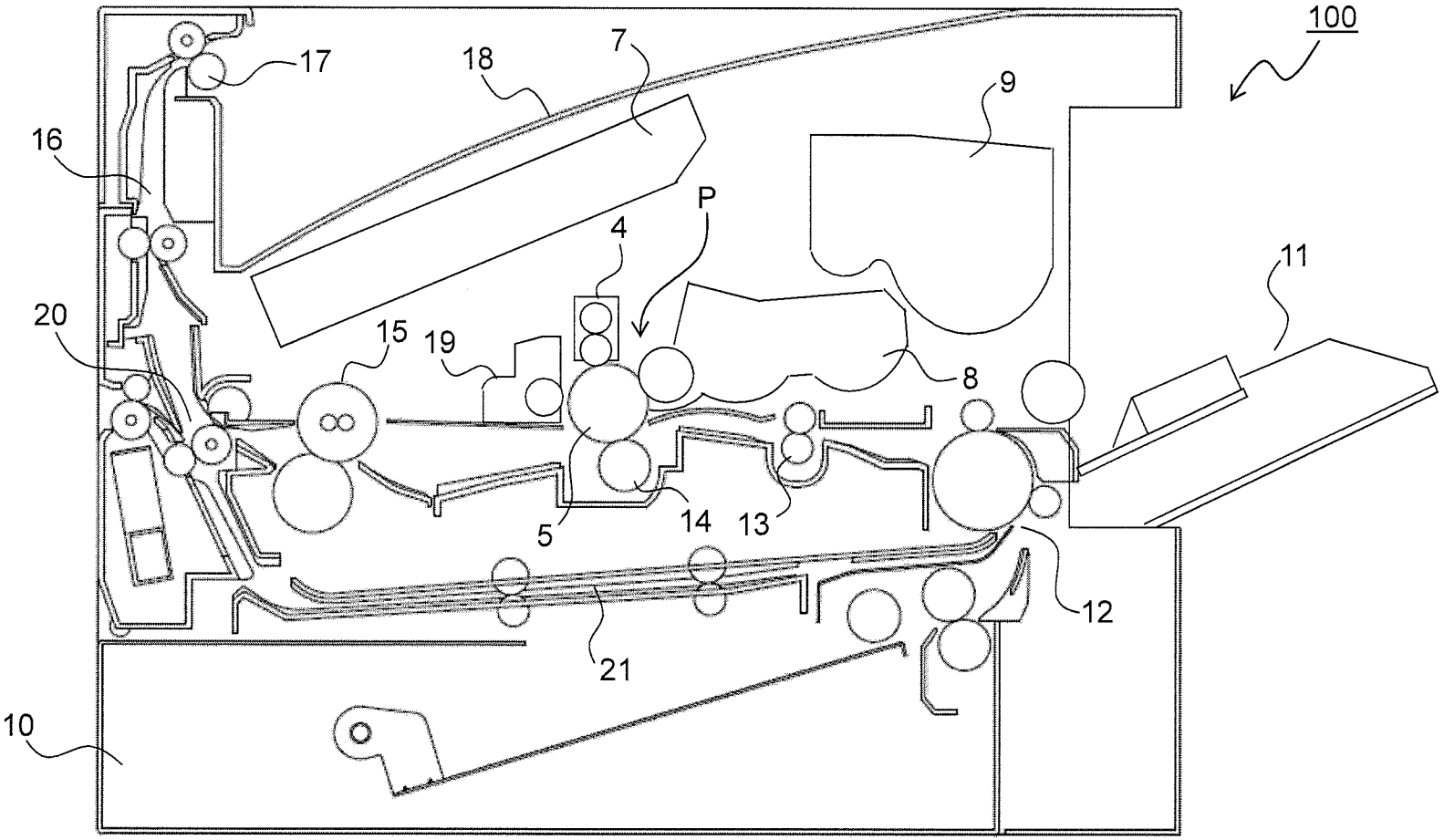
FIG. 1 is a side sectional view showing an internal construction of an image forming apparatus 100 incorporating a sheet discharging device 30 according to the present disclosure.

Hereinafter, an embodiment of the present disclosure will be described with reference to the accompanying drawings. FIG. 1 is a side sectional view showing the internal construction of an image forming apparatus 100 incorporating a sheet discharging device 30 according to the present disclosure. Inside the image forming apparatus 100 (e.g., a monochrome printer), there is arranged an image forming section P which forms a monochrome image through the processes of electrostatic charging, exposure to light, image development, and image transfer. In the image forming section P, there are arranged, along the rotation direction (in FIG. 1, the clockwise direction) of a photosensitive drum 5, a charging unit 4, an exposure unit (such as a laser scanning unit) 7, a developing unit 8, a transfer roller 14, a cleaning device 19, and a destaticizing device (unillustrated).

When image formation is performed, a photosensitive drum 5 which rotates in the clockwise direction is electrostatically charged uniformly by the charging unit 4, an electrostatic latent image is formed on the photosensitive drum 5 by a laser beam from the exposure unit 7 based on document image data, and developer (hereinafter referred to as toner) is attached to the electrostatic latent image by the developing unit 8 to form a toner image.

The toner is fed to the developing unit 8 from a toner container 9. The image data is transmitted from a personal computer (unillustrated) or the like. The destaticizing device for eliminating electrical charge that remains on the surface of the photosensitive drum 5 is provided on the downstream side of the cleaning device 19.

Toward the photosensitive drum 5 having the toner image formed on it as described above, a sheet of paper is transported from a sheet feed cassette 10 or a manual feed device 11 through a sheet transport passage 12 via a registration roller pair 13, and the toner image formed on the surface of the photosensitive drum 5 is transferred to the sheet by a transfer roller 14 (image transfer portion). The sheet having the toner image transferred to it is separated from the photosensitive drum 5, is transported to a fixing device 15, where the toner image is fixed. The sheet having passed through the fixing device 15 is transported through a sheet transport passage 16 to an upper part of the apparatus. When an image is formed only on one side of the sheet (one-side printing), the sheet is then discharged onto a discharge tray 18 by a discharge roller 17 provided in a sheet discharging device 30 (see FIG. 2).

On the other hand, when an image is formed on each side of the sheet (both-side printing), after the trailing edge of the sheet has passed through a bent portion 20 of the sheet transport passage 16, the transport direction of the sheet is reversed. Thus, the sheet is directed to a reverse transport passage 21 which branches off the bent portion 20, and is transported by the registration roller pair 13 once again, now with the image side reversed. Then the next toner image formed on the photosensitive drum 5 is transferred by the transfer roller 14 to the side of the sheet on which no image has yet been formed. The sheet having the toner image transferred to it is transported to the fixing device 15, where the toner image is fixed, and is then discharged onto the discharge tray 18 by the discharge roller 17.

Figure 2:
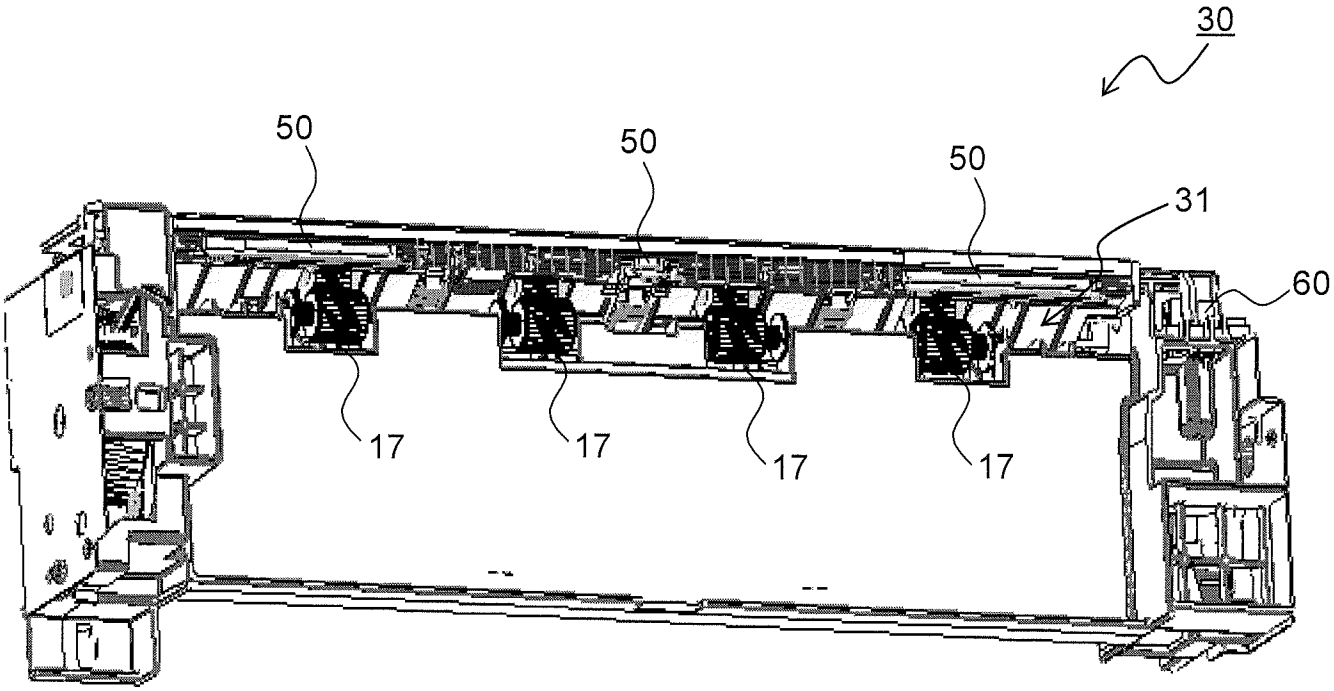
FIG. 2 is a perspective view of a sheet discharging device 30 according to the present disclosure, as seen from the downstream side with respect to the sheet discharge direction.

FIG. 2 is a perspective view of the sheet discharging device 30 as seen from the downstream side with respect to the sheet discharge direction. The discharge roller 17 comprises four pairs of rollers substantially evenly spaced apart in the width direction (in FIG. 2, the horizontal direction) of a sheet discharge port 31, and serves to discharge onto the discharge tray 18 (see FIG. 1) the sheet that has been transported from the upstream side with respect to the sheet transport direction.

Around the downstream side of the sheet discharge port 31 with respect to the sheet discharge direction, there are arranged sheet pressing members 50 for pressing the top face of the sheet discharged through the sheet discharge port 31. The sheet pressing members 50 are supported, at a total of three places, specifically one at the center and two at left and right respectively in the sheet width direction, on a pivot shaft 51 (see FIGS. 3 and 5) so as to be swingable about it in the sheet discharge direction. The sheet pressing members 50 at left and right are longer than the one at the center in the sheet width direction.

Figure 3:
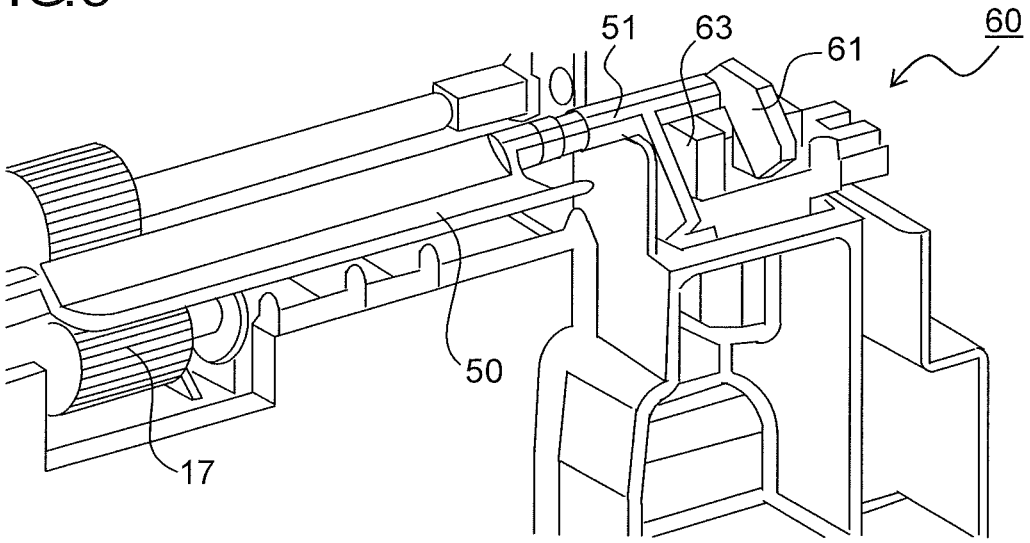
FIG. 3 is an enlarged view of a part of a full-load detecting portion 60 provided at one end of a sheet discharging device 30.

At one end (in FIG. 2, the right end) of the sheet discharging device 30, there is provided a full-load detecting portion 60 for detecting the fully loaded condition of sheets discharged onto the discharge tray 18. As shown in FIG. 3, the full-load detecting portion 60 has a light-blocking plate 61 fixed to one end of the pivot shaft 51, and a detector/sensor 63 which is switched between an on state and an off state by the light-blocking plate 61. The light-blocking plate 61 reciprocates vertically as the sheet pressing members 50 swing. The detector/sensor 63 is a PI (photointerruptor) having a light emitter and a light receiver arranged on opposite inner faces of a U-shaped structure.

With no sheet on the discharge tray 18, the sheet pressing members 50 hang vertically, and thus the light-blocking plate 61 blocks the optical path between the light emitter and the light receiver of the detector/sensor 63. As sheets are discharged onto the discharge tray 18, the bottom end of the sheet pressing members 50 comes into contact with the top face of the sheets and then gradually swings upward, and together the light-blocking plate 61 fixed to the pivot shaft 51 moves upward. When a predetermined quantity of sheets have been discharged onto the discharge tray 18, the light-blocking plate 61 moves out of the optical path between the light emitter and the light receiver, and thus the light-reception signal level of the light receiver turns from low to high. This allows detection of the fully loaded condition of the sheets discharged onto the discharge tray 18.

Incidentally, when a sheet is discharged from the discharge roller 17, the sheet pressing members 50 swing, and thus the light-blocking plate 61 temporarily moves upward, out of the optical path between the light emitter and the light receiver. However, the detector/sensor 63 detects the fully loaded condition of sheets only when the light-reception signal level, after turning from low to high, remains high for a predetermined period continuously. This prevents a sheet discharge action from causing erroneous detection of a fully loaded condition of sheets.

When the sheets on the discharge tray 18 are detected to be fully loaded, the user is notified accordingly with, for example, a message displayed on a liquid crystal display portion (unillustrated) on an operation panel. Thus, the sheet pressing members 50 also serve as a full-load detecting member for detecting the fully loaded condition of sheets on the discharge tray 18.

Figure 4:
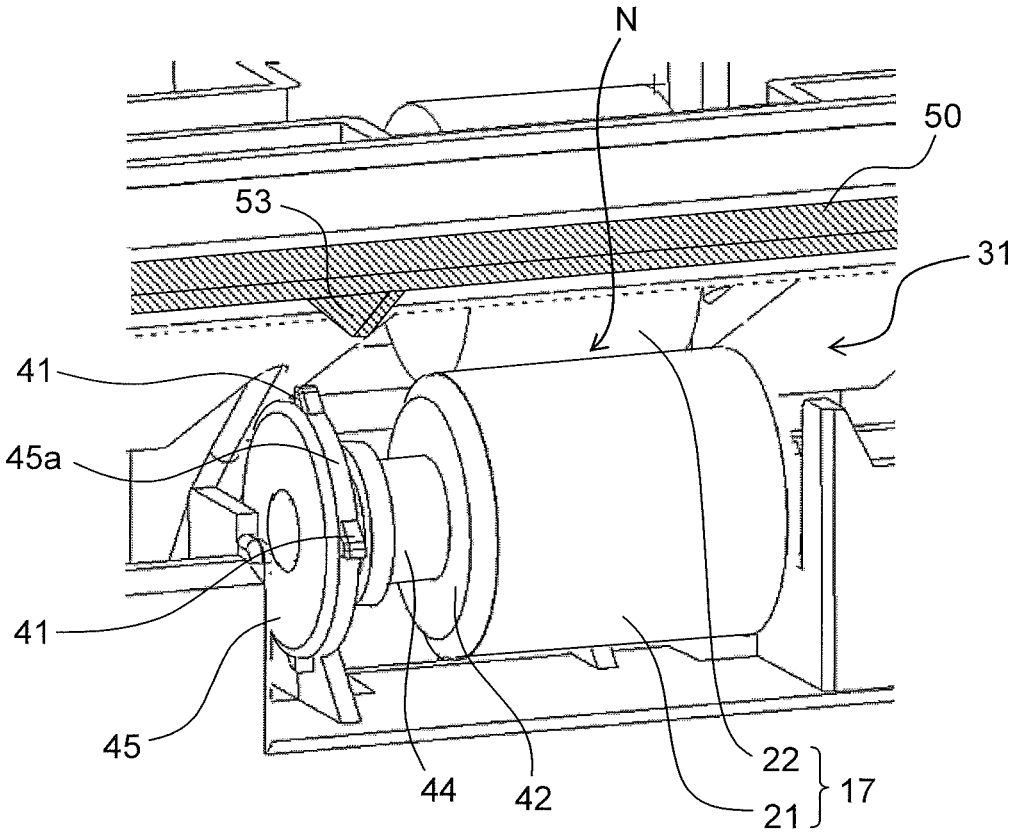
FIG. 4 is a perspective view of and around a discharge roller 17, as seen from the downstream side with respect to the sheet discharge direction.
Figure 5:
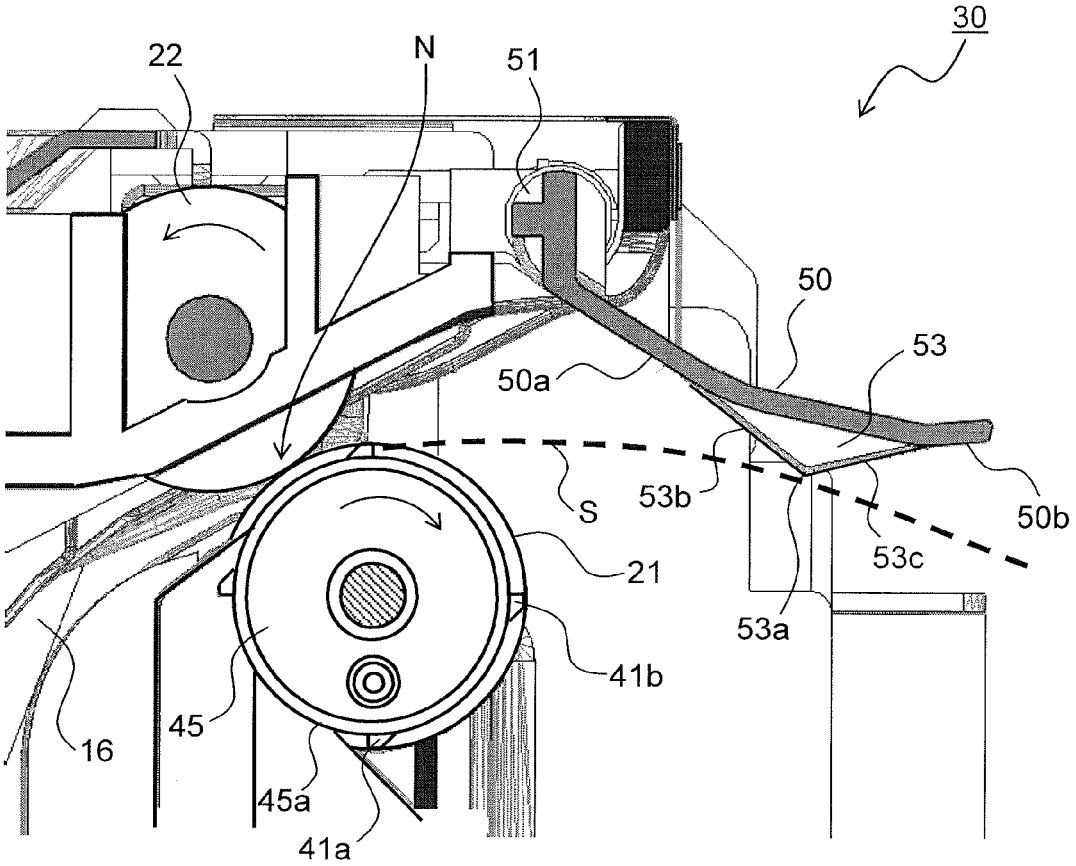
FIG. 5 is a side view of and around a discharge roller 17.

FIG. 4 is a perspective view of and around the discharge roller 17 as seen from the downstream side with respect to the sheet discharge direction, and FIG. 5 is a side view of and around the discharge roller 17. FIGS. 4 and 5 show the leftmost discharge roller 17 in FIG. 2, and the second leftmost discharge roller 17 has a similar structure. The rightmost and second rightmost discharge rollers 17 also have a similar structure except for the arrangement of a flick-off pulley 45.

As shown in FIG. 4, the discharge roller 17 comprises a first roller 21 made of resin and a second roller 22 made of rubber. As shown in FIG. 5, the first roller 21 is arranged under the second roller 22, on the downstream side (in FIG. 5, the right side) of the second roller 22 with respect to the sheet transport direction. As the first roller 21 is driven to rotate, the second roller 22 follows it to rotate in the opposite direction. As the first and second rollers 21 and 22 rotate (indicated by an arrow in FIG. 5), a sheet S (indicated by a broken line in FIG. 5) held at the nip portion N between the first and second rollers 21 and 22 is discharged onto the discharge tray 18. Instead, the second roller 22 may be driven to rotate so that as it rotates, the first roller 21 follows it to rotate.

The first roller 21 has a cylindrical roller body 42 made of resin and a rotary shaft 44 extending from the center of the roller body 42 in the roller width direction (in FIG. 4, the horizontal direction). The rotary shaft 44 has a disc-shaped flick-off pulley 45 formed on it at a predetermined interval from the roller body 42, and on the circumferential edge **45*a* of the flick-off pulley 45, a plurality of (here, four) projections 41** are formed.

The projections 41 are for thrusting forth (flicking off) the trailing edge of a sheet that is discharged as the first roller 21 rotates. The projections 41 are formed integrally with the flick-off pulley 45 so as to protrude from its circumferential edge **45*a*** outward in its radial direction, substantially in a trapezoid shape as seen in a side view.

As shown in FIG. 5, the four projections 41 are evenly spaced in the circumferential direction of the flick-off pulley 45. The four projections 41 comprise two first projections

41*a* located vertically opposite from each other in FIG. 5 and two second projections 41*b* located horizontally opposite from each other in FIG. 5.

Figure 6:
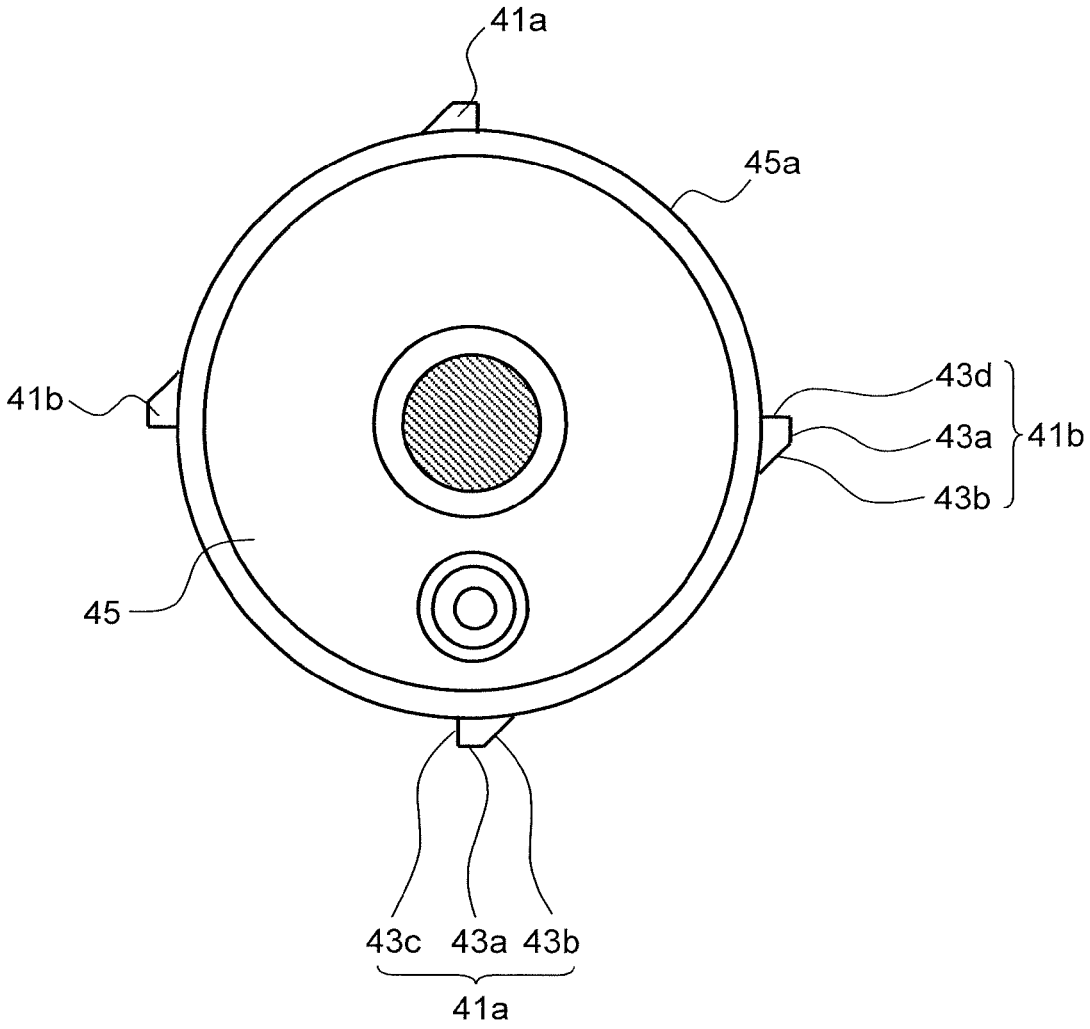
FIG. 6 is a side view of a flick-off pulley 45 having first projections 41*a* and second projections 41*b*.

FIG. 6 is a side view of the flick-off pulley 45 having the first projections 41*a* and the second projections 41*b*. It should be noted that, for all the four discharge rollers 17, flick-off pulleys 45 of a common design are used. Hence, in the leftmost discharge roller 17 shown in FIG. 5, and in the second leftmost discharge roller 17, the second projections 41*b* do not function to flick off the trailing edge of a sheet. On the other hand, in the rightmost and second rightmost discharge rollers 17, the flick-off pulleys 45 are fitted in the reverse direction with respect to the first rollers 21, and thus they rotate, in relative terms, in the reverse direction compared with those in the two left discharge rollers 17, with the result that the second projections 41*b* function to flick off the trailing edge of a sheet, whereas the first projections 41*a* do not.

The first projection 41*a* has a radial tip-end portion 43*a*, a slant face 43*b*, and a first thrusting face 43*c* as a thrusting portion. The radial tip-end portion 43*a* defines the topmost profile of the first projection 41*a* in the roller radial direction, and the radius (distance) from the center of rotation of the flick-off pulley 45 to the radial tip-end portion 43*a* is equal to or smaller than the radius of the roller body 42 of the first roller 21.

With this design, when a sheet S held at the nip portion N is fed forth, the radial tip-end portion 43*a* does make contact with the sheet S, but does not exert a pressing force (load) on the sheet S. This makes it possible to thrust forth the sheet S from the discharge roller 17 onto the discharge tray 18 without damaging the image side of the sheet S.

The slant face 43*b* has a gentle slope so as to connect the upstream-side end of the radial tip-end portion 43*a* to the circumferential edge of the flick-off pulley 45 with respect to the rotation direction of the first roller 21 (in FIG. 5, the clockwise direction).

The first thrusting face 43*c* makes contact with the trailing edge of a sheet S to thrust it forth toward the discharge tray 18, and is a substantially perpendicular face that connects the radial tip-end portion 43*a* to the circumferential edge of the flick-off pulley 45. The first thrusting face 43*c* is formed at the downstream-side end of the first projection 41*a* with respect to the rotation direction (in FIG. 5, the clockwise direction) of the first roller 21. In all the four discharge rollers 17, the flick-off pulley 45 is arranged outward of the first roller 21 with respect to the sheet width direction. For example, in a case where the first roller 21 is used in the leftmost or second leftmost discharge roller 17 in FIG. 2, as shown in FIG. 4, the flick-off pulley 45 is arranged on the left side of the first roller 21 as seen from the downstream side with respect to the sheet discharge direction. Thus, as the first roller 21 rotates, the first thrusting face 43*c* makes contact with the trailing edge of a sheet S, and can thus thrust forth (flick off) the sheet toward the discharge tray 18.

On the other hand, the second projection 41*b* has a radial tip-end portion 43*a*, a slant face 43*b*, and a second thrusting face 43*d* as a thrusting portion. The second projection 41*b* has a similar structure to the first projection 41*a* except for the directions in which the slant face 43*b* and the second thrusting face 43*d* respectively point.

Specifically, the slant face 43*b* has a gentle slope so as to connect the downstream-side end of the radial tip-end portion 43*a* to the circumferential edge of the flick-off pulley 45 with respect to the rotation direction (in FIG. 5, the clockwise direction) of the first roller 21.

The second thrusting face 43*d* makes contact with the trailing edge of a sheet S to thrust it forth toward the discharge tray 18, and is a substantially perpendicular face that connects the radial tip-end portion 41*c* to the circumferential edge of the flick-off pulley 45. The second thrusting face 43*d* is formed on the upstream side of the second projection 41*a* with respect to the rotation direction (in FIG. 5, the clockwise direction) of the first roller 21. In a case where the first roller 21 is used in the rightmost or second rightmost discharge roller 17 in FIG. 2, as the first roller 21 rotates, the second thrusting face 43*d* makes contact with the trailing edge of a sheet S, and can thus thrust forth (flick off) the sheet toward the discharge tray 18.

Moreover, assembly is performed such that the second thrusting faces 43*d* of the rightmost and second rightmost first rollers 21 in FIG. 2 are arranged at the same circumferential-direction positions (at the same phases) as the first thrusting faces 43*c* of the leftmost and second leftmost first rollers 21 in FIG. 2. Thus, when the first rollers 21 rotate in the clockwise direction in FIG. 5, the first thrusting faces 43*c* of the leftmost and second leftmost first rollers 21 and the second thrusting faces 43*d* of the rightmost and second rightmost first rollers 21 simultaneously make contact with the trailing edge of a sheet S, and the first projections 41*a* and the second projections 41*b* thrust forth the sheet toward the discharge tray 18.

If a sheet passing through the discharge roller 17 is back-curled (curled rearward with respect to the image side), the thrusting force of the projections 41 may be insufficiently transmitted to the trailing edge of the sheet, and the trailing edge of the sheet may then remain suspended near the sheet discharge port 31. To prevent that, according to the present disclosure, the thrusting-forth (flicking-off) by the projections 41 is reinforced with pressing ribs 53 which are arranged on the left and right sheet pressing members 50 arranged opposite the discharge roller 17.

The pressing ribs 53 are formed on the opposite face 50*a* of the sheet pressing members 50 opposite the discharge roller 17, at positions overlapping the flick-off pulleys 45 (projections 41) in the axial direction of the pivot shaft 51. The pressing rib 53 has a first slant face 53*b* which is inclined toward the pivot shaft 51 from a peak 53*a* and a second slant face 53*c* which is inclined toward the tip end 50*b* of the sheet pressing member 50 from the peak 53*a*; the pressing rib 53 is thus V-shaped as seen in a side view. The pressing rib 53 is arranged substantially at the center of the sheet pressing member 50 in its width direction. The pressing ribs 53 are arranged opposite the outer two (leftmost and rightmost) of the four discharge rollers 17; no pressing ribs are arranged opposite the inner two (second leftmost and second rightmost) discharge rollers 17.

Next, a description will be given of how the pressing ribs 53 reinforces the thrusting-forth (flicking-off) of a sheet. As shown in FIG. 5, when the leading edge of a sheet S that has passed through the nip portion N of the discharge roller 17 reaches the opposite face 50*a* of the sheet pressing member 50, the sheet S is transported in the discharge direction while making the sheet pressing members 50 swing in the counterclockwise direction. The discharge direction of the sheet S so curves as to be increasingly downward along the first slant face 53*b* of the pressing ribs 53 which are continuous with the opposite face 50*a*.

Here, the peak 53*a* is formed so as to be smoothly continuous with the opposite face 50*a* of the sheet pressing member 50. Thus, when the leading edge of a sheet S moves from the opposite face 50*a* onto the pressing rib 53, no collision noise is produced. Thus, the discharge direction of the sheet S can be changed smoothly.

Owing to the pressing ribs 53 being formed at positions overlapping the projections 41 in the axial direction of the pivot shaft 51, when a sheet S passes by the peak 53*a* of the pressing ribs 53 while making the sheet pressing members 50 swing, the peak 53*a* is located at a height equal to or lower than the height of the projections 41 as seen from the downstream side (in FIG. 5, the right side) with respect to the discharge direction. Thus, the trailing edge of the sheet S is pressed down by the peak 53*a*, so that the sheet S is discharged in a state held between the pressing ribs 53 and the projections 41 from above and below. Thus, even with a back-curled sheet S, its part opposite the projections 41 can reliably be pressed downward. This helps reinforce the thrusting-forth of the trailing edge of a sheet S by the projections 41, and thus helps prevent the trailing edge from remaining suspended.

When a sheet S passes by the peak 53*a* of the pressing ribs 53, with the peak 53*a* located at a height lower than the projections 41, the force with which the sheet S is held from above and below may be so strong that the projections 41 exert an excessively strong pressing force on the sheet S. To prevent that, it is preferable that, while the sheet is passing by the peak 53*a* of the pressing ribs 53, the peak 53*a* be at the same height (on the same horizontal plane) as the projections 41.

As described above, a sheet S discharged from the discharge roller 17 is, while being pressed downward by the sheet pressing members 50 having the pressing ribs 53 provided on them, reliably thrust forth in the discharge direction by the projections 41 formed on the flick-off pulleys 45 so as to be discharged onto the discharge tray 18. This prevents the sheet from remaining suspended near the sheet discharge port 31, and thus helps improve the neatness of sheets stacked on the discharge tray 18.

Figure 7:
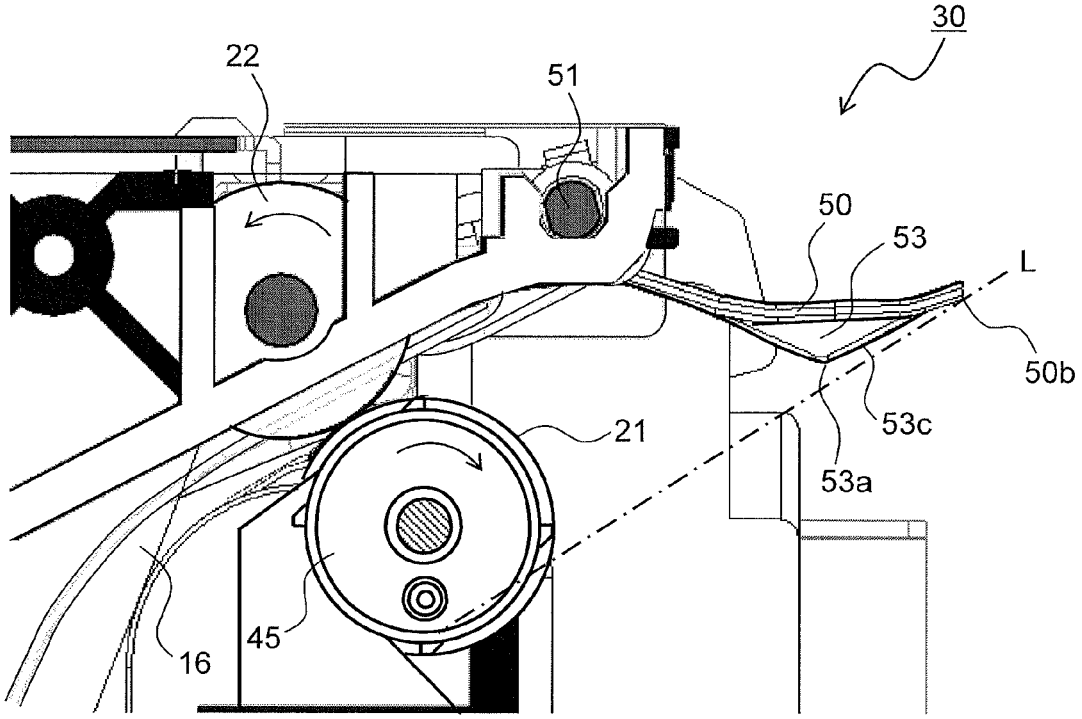
FIG. 7 is a side view of and around the discharge roller 17, as observed when the sheets on a discharge tray 18 is in a fully loaded condition.

FIG. 7 is a side view of and around the discharge roller 17 as observed when sheets are fully loaded on the discharge tray 18. When the top face of the sheets discharged onto the discharge tray 18 is at a height equal to or larger than a predetermined height, the sheet pressing members 50 swing to block the optical path of the detector/sensor 63 (see FIG. 3), and thus the sheets on the discharge tray 18 are detected to be fully loaded. Here, the tip end 50*b* of the sheet pressing members 50 is located further downstream than the pressing ribs 53. On the other hand, as shown in FIG. 1, the discharge tray 18 is inclined downward toward the upstream side (in FIG. 1, the left side) with respect to the sheet discharge direction. Thus, also the top face of a sheet discharged onto the discharge tray 18 is inclined, along the discharge tray 18, downward toward the upstream side with respect to the sheet discharge direction.

Accordingly, as shown in FIG. 7, when the fully loaded state of sheets is detected based on the swinging of the sheet pressing member 50, if the angle of the second slant face 53*c* of the pressing rib 53 relative to the horizontal plane is larger than the angle of the top face (indicated by a dash-and-dot line L in FIG. 7) of the sheets, only the tip end 50*b* of the sheet pressing member 50 makes contact with the top face of the sheets, and the peak 53*a* or the second slant face 53*c* of the pressing rib 53 does not make contact with the top face of the sheets. This positional relationship prevents the pressing ribs 53 from affecting the detection of the fully loaded state.

The present disclosure is not limited by the embodiment described above, and allows for many modifications without departing from the spirit of the present disclosure. For example, although the above embodiment deals with an example where the pressing ribs 53 are provided on the sheet pressing members 50 located opposite the leftmost and rightmost discharge rollers 17, an additional sheet pressing member 50 may be provided opposite the second leftmost or second rightmost discharge roller 17, and a pressing rib 53 may be formed on this sheet pressing member 50.

Although the above embodiment deals with an example where the light-blocking plate 61 for blocking the optical path of the detector/sensor 63 is fixed to the pivot shaft 51 of the sheet pressing members 50 so that the sheet pressing members 50 also serve as a full-load detecting member, instead a full-load detecting member may be provided separately from the sheet pressing members 50, or no full-load detecting member may be provided at all.

Needless to say, the present disclosure finds application not only in monochrome printers like the one shown in FIG. 1, but also in any other types of image forming apparatuses, such as color printers, monochrome and color copiers, digital multifunction peripherals, and facsimile machines.

The present disclosure finds application in sheet discharging devices incorporated in image forming apparatuses. According to the present disclosure, it is possible to provide a sheet discharging device that reliably thrusts forth a sheet from a discharge roller without damaging the sheet or the image on the sheet, and to provide an image forming apparatus incorporating such a sheet discharging device.

What is claimed is:

1. A sheet discharging device comprising:

a discharge port through which a sheet is discharged;

a discharge tray which receives the sheet discharged through the discharge port;

a discharge roller including a first roller and a second roller, the first and second rollers nipping the sheet at a nip portion therebetween so as to discharge the sheet through the discharge port onto the discharge tray;

a flick-out pulley formed coaxially with a rotary shaft of the first roller at an interval from an end of the first roller, the flick-out pulley having a circumferential edge and a plurality of projections protruding from the circumferential edge; and a sheet pressing member supported on a pivot axis provided on a downstream side of the discharge roller with respect to a sheet discharge direction so as to be swingable in the sheet discharge direction, wherein the sheet pressing member has a pressing rib protruding from an opposite face thereof opposite the discharge roller, the pressing rib being arranged at a position overlapping the flick-out pulley in a direction along the pivot axis as seen from the sheet discharge direction, and a distance from a center of rotation of the flick-out pulley to a tip end of the projections in a radial direction is equal to or smaller than a radius of the first roller.

2. The sheet discharging device of claim 1, wherein the pressing rib is substantially in a V-shape as seen in a side view, and has a first slant face inclined toward an upstream side with respect to the sheet discharge direction from a peak of the V-shape to the opposite face and a second slant face inclined toward a downstream side with respect to the sheet discharge direction from the peak to the opposite face.

3. The sheet discharging device of claim 2, wherein the first slant face is formed so as to be smoothly continuous from the opposite face to the peak.

4. The sheet discharging device of claim 2, comprising:

the sheet pressing member which swings by making contact with a top face of sheets placed on the discharge tray; and a detector which detects swinging of the sheet pressing member, wherein a fully loaded condition of sheets placed on the discharge tray is detected as a result of the sheet pressing member swinging in the sheet discharge direction as a number of sheets placed on the discharge tray varies, and when the sheet pressing member has swung to a position where the sheet pressing member detects the fully loaded condition of the sheets, an angle of the second slant face relative to a horizontal plane is larger than an angle of a top face of the sheets placed on the discharge tray relative to the horizontal plane.

5. The sheet discharging device of claim 1, wherein the projections comprise a pair of first projections located opposite from each other about a center of rotation of the flick-out pulley and a pair of second projections located opposite from each other about the center of rotation of the flick-out pulley, and the first and second projections respectively have first thrusting faces and second thrusting faces for flicking out a trailing edge of a sheet, the first projections having the first thrusting faces arranged on a downstream side with respect to a direction of the rotation of the flick-out pulley, the second projections having the second thrusting faces arranged on an upstream side with respect to the direction of the rotation of the flick-out pulley.

6. An image forming apparatus comprising the sheet discharging device of claim 1.

7. A sheet discharging device comprising:

a discharge port through which a sheet is discharged;

a discharge tray which receives the sheet discharged through the discharge port;

a discharge roller including a first roller and a second roller, the first and second rollers nipping the sheet at a nip portion therebetween so as to discharge the sheet through the discharge port onto the discharge tray;

a flick-out pulley formed coaxially with a rotary shaft of the first roller at an interval from an end of the first roller, the flick-out pulley having a circumferential edge and a plurality of projections protruding from the circumferential edge; and a sheet pressing member supported on a pivot axis provided on a downstream side of the discharge roller with respect to a sheet discharge direction so as to be swingable in the sheet discharge direction, wherein the sheet pressing member has a pressing rib protruding from an opposite face thereof opposite the discharge roller, the pressing rib being arranged at a position overlapping the flick-out pulley in a direction along the pivot axis as seen from the sheet discharge direction, the projections comprise a pair of first projections located opposite from each other about a center of rotation of the flick-out pulley and a pair of second projections located opposite from each other about the center of rotation of the flick-out pulley, and the first projections respectively have radial-direction tip ends, slant faces, and first thrusting faces for flicking out a trailing edge of a sheet, the second projections respectively have radial-direction tip ends, slant faces, and second thrusting faces for flicking out a trailing edge of a sheet, the slant faces are arranged with such an inclination as to connect downstream-side ends of the radial-direction tip ends to a circumferential edge of the flick-off pulley with respect to a rotation direction of the first roller, the first and second thrusting faces are substantially upright faces that connect the radial-direction tip ends to the circumferential edge of the flick-off pulley, the first thrusting faces are arranged on a downstream side with respect to a direction of the rotation of the flick-out pulley, and the second thrusting faces are arranged on an upstream side with respect to the direction of the rotation of the flick-out pulley.

* * * * *